US008274424B2

(12) United States Patent
Ahrens et al.

(10) Patent No.: US 8,274,424 B2
(45) Date of Patent: Sep. 25, 2012

(54) INTEGRATED AIRPORT DOMAIN AWARENESS RESPONSE SYSTEM, SYSTEM FOR GROUND-BASED TRANSPORTABLE DEFENSE OF AIRPORTS AGAINST MANPADS, AND METHODS

(75) Inventors: Frederick A. Ahrens, Tucson, AZ (US); Jay A. Stern, Oro Valley, AZ (US); Timothy K. Kirchhoff, Alta Loma, CA (US); Mark P. Slivinski, Tucson, AZ (US); Terrence J. Wolfe, Tucson, AZ (US); Vernon A. Mickle, Tucson, AZ (US); Arthur D. Dilley, Tucson, AZ (US); Daniel F. Cheeseman, Tucson, AZ (US); Timothy M. Minahen, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 296 days.

(21) Appl. No.: 12/713,400

(22) Filed: Feb. 26, 2010

(65) Prior Publication Data

US 2011/0030538 A1 Feb. 10, 2011

Related U.S. Application Data

(60) Provisional application No. 61/155,614, filed on Feb. 26, 2009.

(51) Int. Cl.
*G01S 13/86* (2006.01)

(52) U.S. Cl. ..... 342/36; 342/52; 342/55; 342/67

(58) Field of Classification Search ..... 342/13–15, 342/36, 67, 52–56

See application file for complete search history.

(56) References Cited

U.S. PATENT DOCUMENTS

| | | | | |
|---|---|---|---|---|
| 3,378,835 | A * | 4/1968 | Mooney, Jr. et al. | 342/59 |
| 3,981,010 | A * | 9/1976 | Michelsen | 342/55 |
| 4,456,912 | A * | 6/1984 | Ensley | 342/13 |
| 4,647,759 | A * | 3/1987 | Worsham et al. | 235/411 |
| 4,990,919 | A * | 2/1991 | Manoogian | 342/13 |

(Continued)

FOREIGN PATENT DOCUMENTS

EP 964381 A2 * 12/1999

(Continued)

OTHER PUBLICATIONS

"International Application Serial No. PCT/US2010/000574, Search Report mailed Nov. 3, 2010", 4 pgs.

(Continued)

*Primary Examiner* — John B Sotomayor

(74) *Attorney, Agent, or Firm* — Schwegman Lundberg & Woessner, P.A.

(57) ABSTRACT

Embodiments of an apparatus and method for defending a physical zone from airborne and ground-based threats are disclosed. In the various embodiments, an apparatus includes a detection component configured to detect and track a ground-based or airborne threat proximate to the physical zone, an integration component to receive data from the detection component and process the data to determine a threat assessment. A defensive component receives the determined threat assessment and disables the ground-based and airborne threat based upon the determined threat assessment. A method includes detecting an object proximate to the physical zone to be protected, identifying the object as a hostile threat, determining at least one of a path and a point-of-origin for the object, and actuating a defensive system in response to the hostile threat.

20 Claims, 4 Drawing Sheets

U.S. PATENT DOCUMENTS

| | | | | |
|---|---|---|---|---|
| 5,379,676 | A * | 1/1995 | Profeta et al. | 89/41.05 |
| 5,917,442 | A * | 6/1999 | Manoogian | 342/62 |
| RE36,944 | E * | 11/2000 | Li | 342/58 |
| 6,414,622 | B1 * | 7/2002 | Rougas | 342/13 |
| 6,666,401 | B1 * | 12/2003 | Mardirossian | 244/3.11 |
| 6,873,903 | B2 * | 3/2005 | Baiada et al. | 701/120 |
| 6,995,660 | B2 * | 2/2006 | Yannone et al. | 340/425.5 |
| 7,551,121 | B1 * | 6/2009 | O'Connell et al. | 342/54 |
| 7,652,234 | B2 * | 1/2010 | Shukrun | 244/3.15 |
| 7,714,261 | B2 * | 5/2010 | Bnayahu et al. | 250/203.6 |
| 7,791,536 | B2 * | 9/2010 | Brown et al. | 342/374 |
| 7,876,258 | B2 * | 1/2011 | Abraham et al. | 342/29 |
| 7,961,133 | B2 * | 6/2011 | Vollin et al. | 342/14 |
| 8,179,310 | B2 * | 5/2012 | Westphal | 342/357.4 |
| 2003/0137444 | A1 * | 7/2003 | Stone et al. | 342/30 |
| 2004/0039518 | A1 * | 2/2004 | Jasselin | 701/120 |
| 2005/0187677 | A1 | 8/2005 | Walker | |
| 2005/0259848 | A1 | 11/2005 | Garoutte | |
| 2006/0283317 | A1 * | 12/2006 | Melnychuk et al. | 89/41.03 |
| 2006/0284050 | A1 | 12/2006 | Busse et al. | |
| 2007/0150127 | A1 | 6/2007 | Wilson, Jr. et al. | |
| 2007/0236382 | A1 | 10/2007 | Dove | |
| 2008/0316101 | A1 * | 12/2008 | Brown et al. | 342/374 |
| 2009/0173788 | A1 * | 7/2009 | Moraites et al. | 235/411 |
| 2009/0260511 | A1 * | 10/2009 | Melnychuk et al. | 89/1.11 |
| 2010/0042269 | A1 * | 2/2010 | Kokkeby et al. | 701/3 |
| 2010/0253567 | A1 * | 10/2010 | Factor et al. | 342/52 |
| 2010/0283657 | A1 * | 11/2010 | Vollin et al. | 342/14 |
| 2011/0030538 | A1 * | 2/2011 | Ahrens et al. | 89/1.11 |

FOREIGN PATENT DOCUMENTS

| | | | |
|---|---|---|---|
| WO | WO 9411751 | A1 * | 5/1994 |
| WO | WO 2010144105 | A2 * | 12/2010 |
| WO | WO-2010144105 | A3 | 1/2011 |
| WO | WO-2010144105 | A4 | 3/2011 |

OTHER PUBLICATIONS

"International Application Serial No. PCT/US2010/000574, Written Opinion mailed Nov. 3, 2010", 10 pgs.

"International Application Serial No. PCT/US2010/000574, International Preliminary Report on Patentability mailed Sep. 9, 2011", 10 pgs.

* cited by examiner

INTEGRATED AIRPORT DOMAIN AWARENESS RESPONSE SYSTEM, SYSTEM FOR GROUND-BASED TRANSPORTABLE DEFENSE OF AIRPORTS AGAINST MANPADS, AND METHODS

CROSS-REFERENCES TO RELATED APPLICATIONS

This application claims the benefit of U.S. Provisional Application No. 61/155,614, filed Feb. 26, 2009, the disclosure of which is incorporated herein by reference in its entirety.

TECHNICAL FIELD

Embodiments pertain to air traffic management for commercial and military airport environments. Embodiments also pertain to responding to threats in commercial and military airport environments.

BACKGROUND

One problem with current air traffic management in commercial and military airport environments is the lack of available and consistent situational awareness and response capability in and around airports and airbases. Individual systems exist that perform independent functions, but they do not work in a collaborative environment. This could lead to an inability to respond to various threats in a timely manner.

Thus there are general needs for an Integrated Airport Domain Awareness and Response System and Method that integrates individual systems, operates collaboratively, and responds to various threats in a timely manner. There are also general needs for a system for Ground-Based Transportable Defense of Airports against man-portable air-defense systems (MANPADS) to provide airspace security for high profile events like the Olympics, for overseas military and logistics bases, and for the destinations of VIP aircraft such as Air Force One.

SUMMARY

An apparatus and method for defending a physical zone from airborne and ground-based threats are described. In an aspect, an apparatus may include a detection component configured to detect and track a ground-based or airborne threat proximate to the physical zone, an integration component to receive data from the detection component and process the data to determine a threat assessment. A defensive component receives the determined threat assessment and disables the ground-based and airborne threat based upon the determined threat assessment. In another aspect, a method may include detecting an object proximate to the physical zone to be protected, identifying the object as a hostile threat, determining at least one of a path and a point-of-origin for the object, and actuating a defensive system in response to the hostile threat.

DETAILED DESCRIPTION

The following description and the drawings sufficiently illustrate the various embodiments to enable those skilled in the art to practice them. Other embodiments may incorporate structural, logical, electrical, process, and other changes. Accordingly, the examples described herein merely typify possible variations. Individual components and functions may be optional, and the sequence of operations may also vary. Portions and features of the various embodiments may be included in, or substituted for, those of other embodiments. Therefore, the various embodiments as set forth in the claims are to be interpreted as encompassing all available equivalents of those claims.

The various embodiments provide an Integrated Airport Domain Awareness and Response System (IADARS) and methods that provide increased situational awareness and response time reduction when external threats are directed to a protected location or zone. For example, the protected location may include a commercial airport, a military base, a nuclear facility, or other sensitive locations and their immediate environs. In the various embodiments, the IADARS may provide data generation and analysis, information sharing and knowledge in a persistent, three-dimensional infrastructure that enhances situational awareness and response capability. Through shared resources and data management and storage, both real-time and post-event forensic capability become available. Infrastructure costs and user workload are also reduced through common subsystems.

Figure 1:
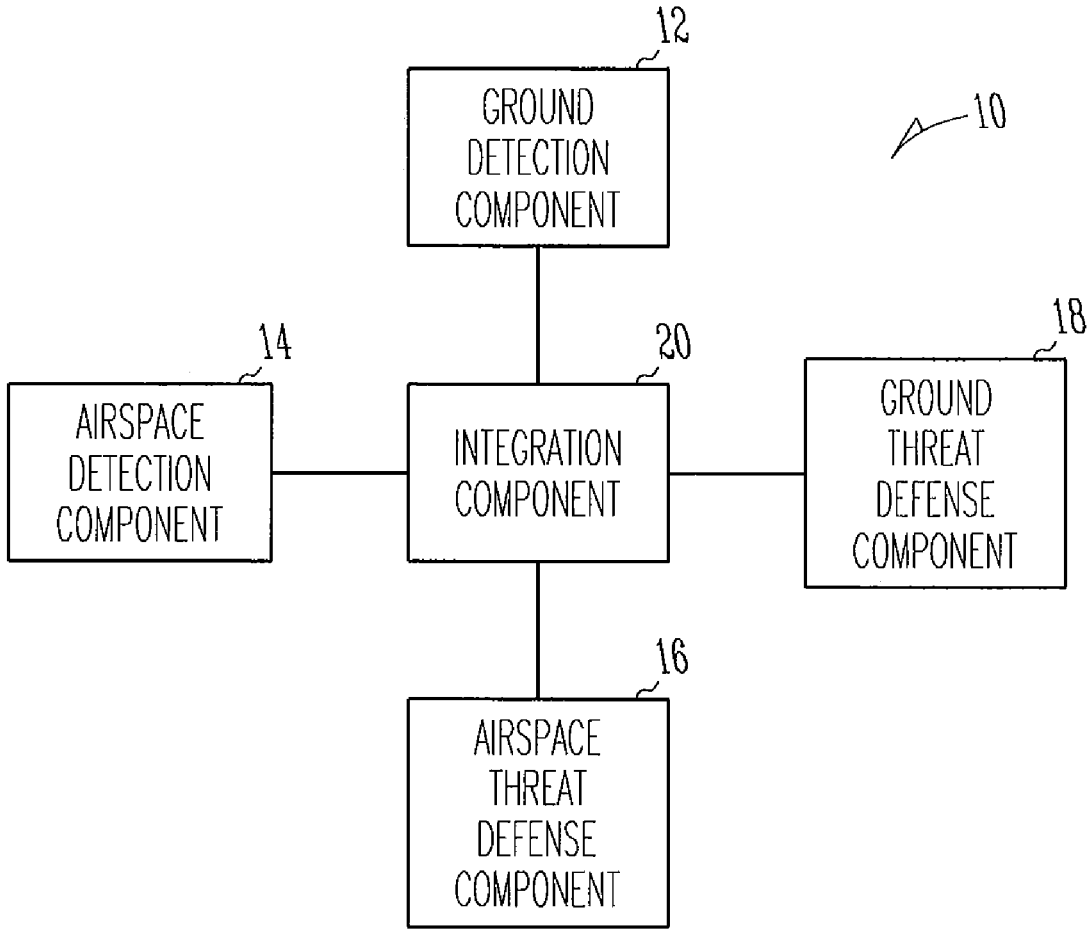
FIG. 1 is a diagrammatic block view of an Integrated Airport Domain Awareness and Response System (IADARS) according to the various embodiments.

FIG. 1 is a diagrammatic block view of an Integrated Airport Domain Awareness and Response System (IADARS) 10 according to the various embodiments. The IADARS 10 may include a ground detection component 12 that is configured to detect an intrusion of a physical perimeter positioned at least partially around a protected location. Accordingly, the ground detection component 12 may include an optical detection capability, which may include video motion detection (VMD) cameras that are configured to record optical images when objects within a field-of-view of the VMD camera change. The optical detection capability may also include pan-tilt-zoom (PTZ) cameras that are configured to be steered towards a desired position proximate to the protected location, and provide a field-of-view at various levels of magnification. The ground detection component 12 may also include a motion detection capability that may include thermal motion detection devices, vibration detection devices or other suitable motion detection devices. The motion detection capability may therefore be located on or within a ground surface proximate to the physical perimeter, or it may be incorporated into structures positioned proximate to the physical perimeter. For example, the motion detection capability may be incorporated in an instrumented security fence positioned proximate to the physical perimeter. One suitable example of an instrumented security fence is disclosed in detail in U.S. Pat. No. 6,731,210 to Swanson, et al., and entitled "SYSTEM AND METHOD FOR DETECTING, LOCALIZING, OR CLASSIFYING A DISTURBANCE USING A WAVEGUIDE SENSOR SYSTEM", which patent is herein incorporated by reference. The motion detection capability may include various radar systems configured to provide radar surveillance proximate to the physical perimeter, and which may further provide radar surveillance of at least a portion of the airspace adjacent the physical perimeter. Information obtained from the foregoing optical and motion detection capabilities may be processed by an associated command and control ($C^2$) apparatus that is configured to process the information. One example of the ground detection component 12 is the Perimeter Intrusion Detection System (PIDS), available from the Raytheon Company, Network Centric Systems Division of McKinney, Tex., although other suitable alternatives exist. Briefly, the PIDS comprises a grid of sensors configured to detect and image unauthorized physical perimeter intrusions by terrestrial objects, such as ground vehicles and persons. The PIDS is configured to monitor and validate intrusion indications, and to facilitate the planning and execution of a directed response to the intrusion.

The IADARS 10 may also include an airspace detection component 14, such as a radar-based air-traffic control (ATC) system. The ATC system may include, for example, a system operable to provide radar surveillance of an airspace and to provide positive control of flight vehicles within the radar-monitored airspace. In the various embodiments, the ATC system may be configured to monitor an airport terminal airspace environment using at least one of a control tower (CT) facility, a Terminal Radar Approach Control (TRACON) facility, a Flight Service Station (FSS) or an Air Route Traffic Control Center (ARTCC). Briefly, and in general terms, the ATC system is configured to monitor and direct approaching and departing aircraft in the airport terminal airspace environment in order to ensure the safety of traffic within the immediate airport terminal airspace, or in other airspace environments, which may include Class B, Class C or Class D airspaces. Other outlying airspace areas, such as Classes A, E, F and G may also be monitored by radar systems associated with the ATC system. The ATC system may also be configured to identify flight vehicles and track flight vehicle positions by primary (e.g., skin-painting) radars and secondary surveillance radar (SSR), such as the Air Traffic Control Radar Beacon System (ATCRBS), which relies upon an aircraft-based transponder that is configured to transmit (e.g., "squawk") signals that include pertinent flight-related information in response to signals from an interrogating ground-based radar.

The IADARS 10 may further include an airspace threat defense component 16 that includes an array of sensors positioned at various locations that may be located within the physical perimeter, adjacent to the physical perimeter, or positioned at a distance from the physical perimeter. Each of the sensors in the array of sensors is configured to detect an airborne object moving across a field-of-view of the sensor. Accordingly, the sensors may be located on a surface of the earth, or positioned on a structure, or even positioned on a terrestrial vehicle so that the array may be readily reconfigured, if desired. In any case, each of sensors in the array of sensors is generally positioned to view a portion of an airspace adjacent to the sensor. In accordance with the various embodiments, the array of sensors may include optical sensors or infrared sensors. Information obtained from the array of sensors may be communicated to a communications and control ($C^2$) apparatus that is configured to process the information and to provide direction and instructions to a directed energy device configured to interfere with the operation of a flight vehicle that is within or approaching the physical perimeter without authorization. For example, the directed energy device may include a directed microwave device that is configured to project microwave energy towards the unauthorized flight vehicle and disable a guidance system associated with the flight vehicle. Accordingly, the strength of an emission may be configured to affect a front end portion of a guidance system receiver, or to enter through other portions of the unauthorized flight vehicle, such as through seams between body portions of the unauthorized flight vehicle, or even through a body portion of the unauthorized vehicle. The emission of the directed energy device may also be suitably modulated to interfere with the unauthorized flight vehicle. One example of an airspace threat defense component 16 is the VIGILANT EAGLE Airport Defense System, available from the Raytheon Company, Missile Systems Division of Tucson Ariz., although other suitable alternatives exist. The VIGILANT EAGLE Airport Defense System may be configured to defeat airborne threats such as a shoulder-fired surface-to-air missiles (SAMs), or Man-Portable Air-Defense Systems (MANPADS), or from actively-guided (e.g., piloted) aircraft or remotely-guided aircraft using high-power microwave (HPM) interference from a focused microwave beam directed at the airborne threat. The VIGILANT EAGLE Airport Defense System may therefore include a distributed Missile Detect-and-Track (MDT) apparatus having a grid of passive airspace detection sensors for tracking airborne threats. VIGILANT EAGLE may also include a command and control ($C^2$) system that receives information from the grid of passive airspace detection sensors and to communicate commands that steer the HPM beam. An Active Electronically Scanned Array (AESA) may be provided to direct the beam, which generally includes a billboard-size array of antennas that are linked to solid-state amplifiers.

The IADARS 10 may include a ground threat defense component 18 that includes a directed beam device that is configured to provide directed energy in response to an unauthorized physical perimeter intrusion by terrestrial objects, such as ground vehicles and personnel. In accordance with the various embodiments, the directed beam device may include an apparatus that is configured to provide a measured (e.g., a non-lethal) response to the unauthorized physical perimeter intrusion, so that the unauthorized ground vehicle or the personnel may be incapacitated when exposed to the directed energy. Alternatively, the directed beam device may be configured to provide a lethal response to an unauthorized perimeter intrusion by ground vehicles and personnel. Accordingly, the directed beam device may be configured to provide directed electromagnetic radiation, such as directed microwave energy, towards ground vehicles and personnel that approach or penetrate the physical perimeter. The directed beam device may also be configured to direct acoustic radiation towards ground vehicles and personnel that approach or penetrate the physical perimeter. Alternatively, the directed beam device may be configured to provide a lethal response to an unauthorized perimeter intrusion. One example of a directed beam device may include the SILENT GUARDIAN Protection System, available from the Raytheon Company, Missile Systems Division of Tucson Ariz., although other suitable alternatives exist. The SILENT GUARDIAN Protection System includes a source of microwave energy that is coupled to a directed antenna that is configured to focus the microwave energy towards unauthorized intruders that may be penetrating or threatening to penetrate the physical perimeter. Since the microwave energy has limited tissue penetration, the SILENT GUARDIAN Protection System is generally non-lethal since it principally generates an intolerable tissue heating effect in the unauthorized intruder. In still other embodiments, the ground defense system 18 may also include a propelled projectile weapon, such as the Phalanx Close-In Weapon System (CIWS), available from the Raytheon Company of Waltham, Mass., although other alternatives exist.

Still referring to FIG. 1, The IADARS 10 may include an integration system 20 that may be operably coupled to the ground detection component 12, the airspace detection component 14, the airspace threat defense component 16, and the ground threat defense component 18 to exchange information with the ground detection component 12, the airspace detection component 14, the airspace threat defense component 16, and the ground threat defense component 18. Briefly, the integration system 20 is operable to process data received from the ground detection component 12, the airspace detection component 14, the airspace threat defense component 16, and the ground threat defense component 18, to coordinate a suitable response to a perceived threat, activate the response and to provide a communications link to one or more law enforcement agencies. Accordingly, the integration system 20 leverages the capabilities of the ground detection component 12, the airspace detection component 14, the airspace threat defense component 16, and the ground threat defense component 18 so that enhanced data generation and analysis may be performed, vital information may be directed where required, and a persistent three-dimensional infrastructure may be provided. The integration system 20 may include a fixed-base-of-operation, such as in a building within or adjacent to the physical perimeter, or it may be remotely positioned relative to the physical perimeter. Further, the integration system 20 may be remotely positionable to provide for protection of a physical perimeter determined to require protection from an airborne or a ground threat. Examples of physical perimeters that might warrant protection from airborne or a ground threats may include sporting events (e.g., events conducted in connection with the International Olympic Games), or other public or private events that may be vulnerable to airborne or ground threats. The integration system 20 will be discussed in greater detail below.

Figure 2:
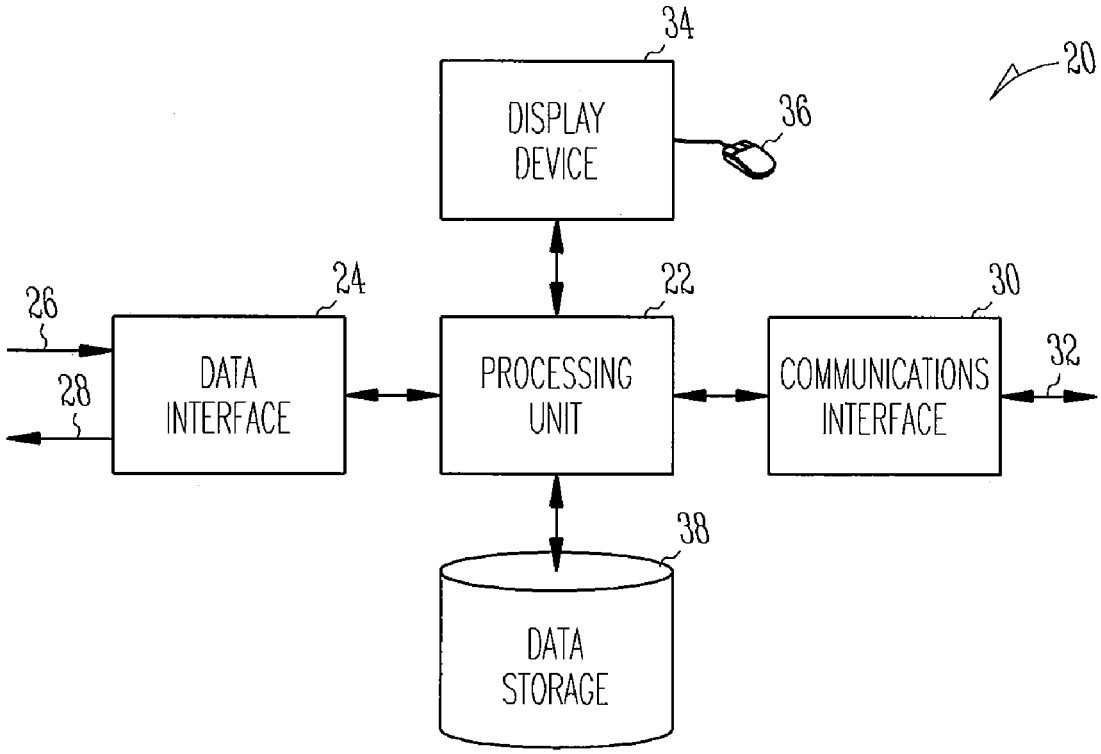
FIG. 2 is a diagrammatic block diagram of an integration system according to the various embodiments.

FIG. 2 is a diagrammatic block diagram of an integration system 20 according to the various embodiments. The integration system 20 may include a processing unit 22 that is configured to receive data and programmed instructions, and to process the data according to the received instructions. Accordingly, the processing unit 22 may be comprised of any suitable general-purpose computational apparatus and operating system, although a special-purpose computational apparatus (e.g., a dedicated apparatus) and operating system may also be used. The processing unit 22 may be coupled to a data interface 24 that is configured to receive a plurality of input signals 26 generated by at least one of the ground detection component 12, the airspace detection component 14, the airspace threat defense component 16, and the ground threat defense component 18 shown in FIG. 1. Accordingly, the data interface 24 may be configured to receive the signals 26 in differing formats and at different data rates, and to buffer and/or appropriately format the signals 26 so that they may be processed by the processing unit 22. Similarly, the data interface 20 may also be configured to receive information from the processing unit 22, and to buffer and/or appropriately format the information so that suitable output signals 28 may be provided to at least one of the ground detection component 12, the airspace detection component 14, the airspace threat defense component 16, and the ground threat defense component 18 of FIG. 1. The processing unit 22 may also be coupled to a communications interface 30 that is operable to receive information from the processing unit 22, and to generate one or more output signals 32 that may be directed to an outside agency. For example, the outside agencies may include various law enforcement agencies that may be required to counter the threat. Accordingly, the output signals 32 may include digital data that may be communicated by encrypted means, if desired, and communicated by a wired or a wireless communications link.

The integration unit 20 may also include a display device 34 that is configured to present visual information generated by the processing unit 22 to a system operator. The display device 34 may be operably coupled to one or more pointing devices 36 that allow the system operator to enter commands to the processing unit 22 based upon the visual information presented on the display device 34. A data storage device 38 may also be coupled to the processing unit 22 so that data received from the data interface 24 and information processed by the processing unit 22 may be stored for later review, or for later forensic analysis, if needed.

Figure 3:
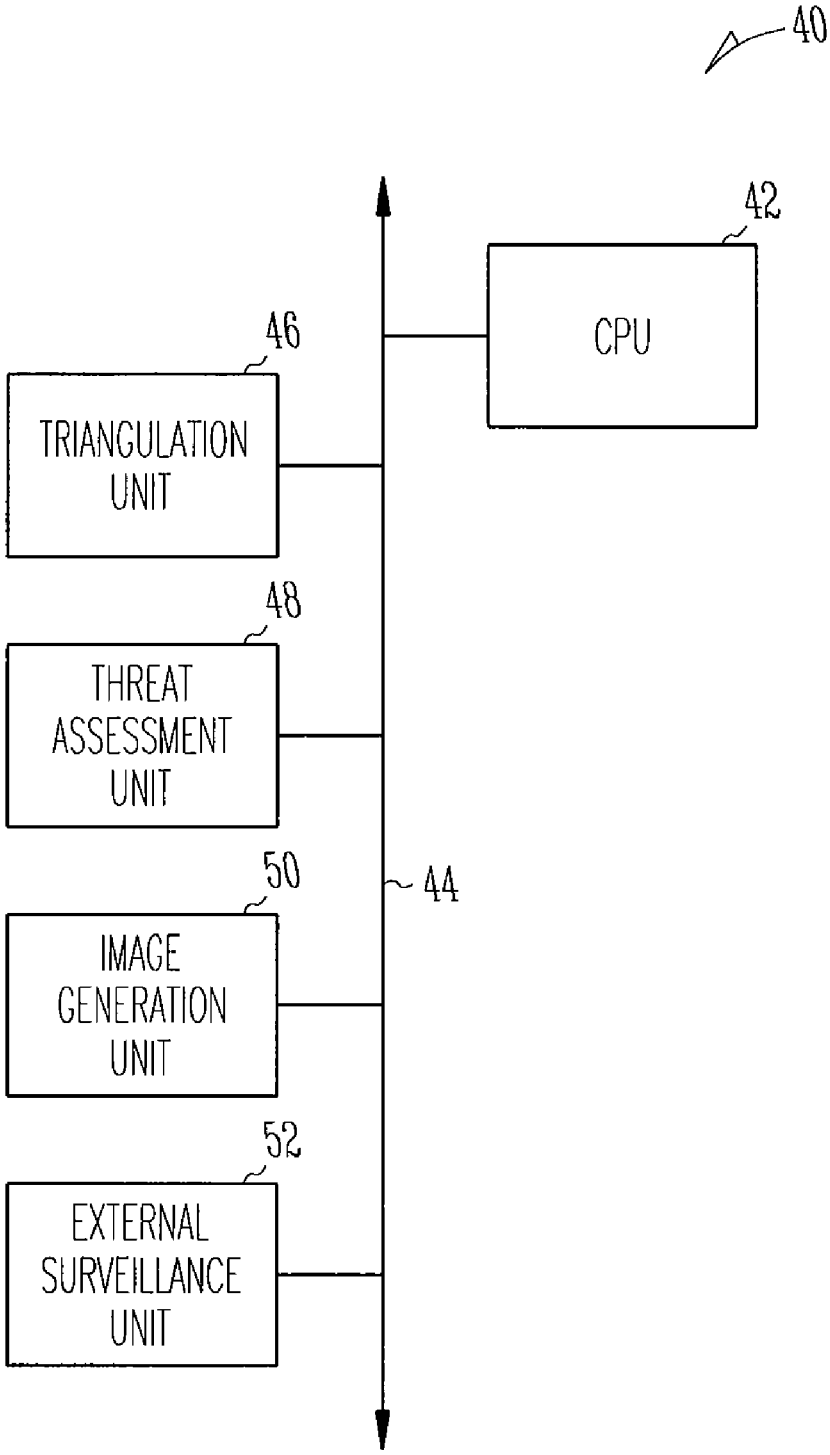
FIG. 3 is a diagrammatic block view of a processing unit of the integration system FIG. 2 according to the various embodiments.

With reference now to FIG. 3, various details of a processing unit 40 that may be used in connection with the integration unit 20 of FIG. 2 will now be described. In the discussion that follows, it is understood that many of the details of the processing unit 40 may be omitted in the interest of brevity, and in the interest of clarity of description. The processing unit 40 may include a general purpose central processing unit (CPU) 42 that is coupled to a communications bus 44 that is further suitably configured to communicate information between the CPU 42 and various computational units, which will now be described in greater detail. A triangulation unit 46 may be coupled to the CPU 42 that may receive suitably processed information from at least one of the ground detection component 12, the airspace detection component 14, the airspace threat defense component 16, and the ground threat defense component 18 shown in FIG. 1 so that a three-dimensional representation of a path of a flight vehicle operating within an airspace region within (or even proximate to) the physical perimeter may be generated. Similarly, a three-dimensional representation for any detected threat may also be computed. Accordingly, the triangulation unit 46 may also be configured to compute a point of origin for the potential threat (e.g., a launching point for a MANPADS) and may also compute a projected point of impact with one or more air vehicles operating within the airspace with authorization. The triangulation unit 46 may further be configured to calculate objects other than a MANPADS, such as an artillery or mortar shell directed into the physical perimeter.

The processing unit 40 may also include a threat assessment unit 48 coupled to the CPU 42 that may also receive suitably processed information from at least one of the ground detection component 12, the airspace detection component 14, the airspace threat defense component 16, and the ground threat defense component 18 shown in FIG. 1 so that a real-time assessment of a threat may be determined. For example, the threat assessment unit 48 may be operable to determine if a detected object is a hostile threat. For example, the threat assessment unit 48 may utilize a trajectory of a detected object, a point of origin of the detected object, a speed of the detected object, the absence of a recognized transponder code from the detected object, or any combination of the foregoing, in addition to other information, in assessing a possible threat. An image generation unit 50 may also be coupled to the CPU 42 through the communications bus 44. The image generation unit 44 may receive information from at least one of the triangulation unit 46 and the threat assessment unit 48 and to suitably process the information for presentation on the display device of FIG. 2. An external surveillance unit 52 may also be coupled to the CPU 42 through the communications bus 44. The external surveillance unit 52 may receive point of origin information from at least the triangulation unit 46, and may be operable to activate optical cameras positioned proximate to a computed point of origin of a possible threat. The external surveillance unit 52 may also be configured to activate optical cameras positioned proximate to a detected ground threat. For example, since the ground detection component 12 (FIG. 1) may include motion detection devices (e.g., thermal motion detection devices and/or vibration detection devices) the external surveillance unit 52 may activate and view an area proximate to the detected ground threat.

Figure 4:
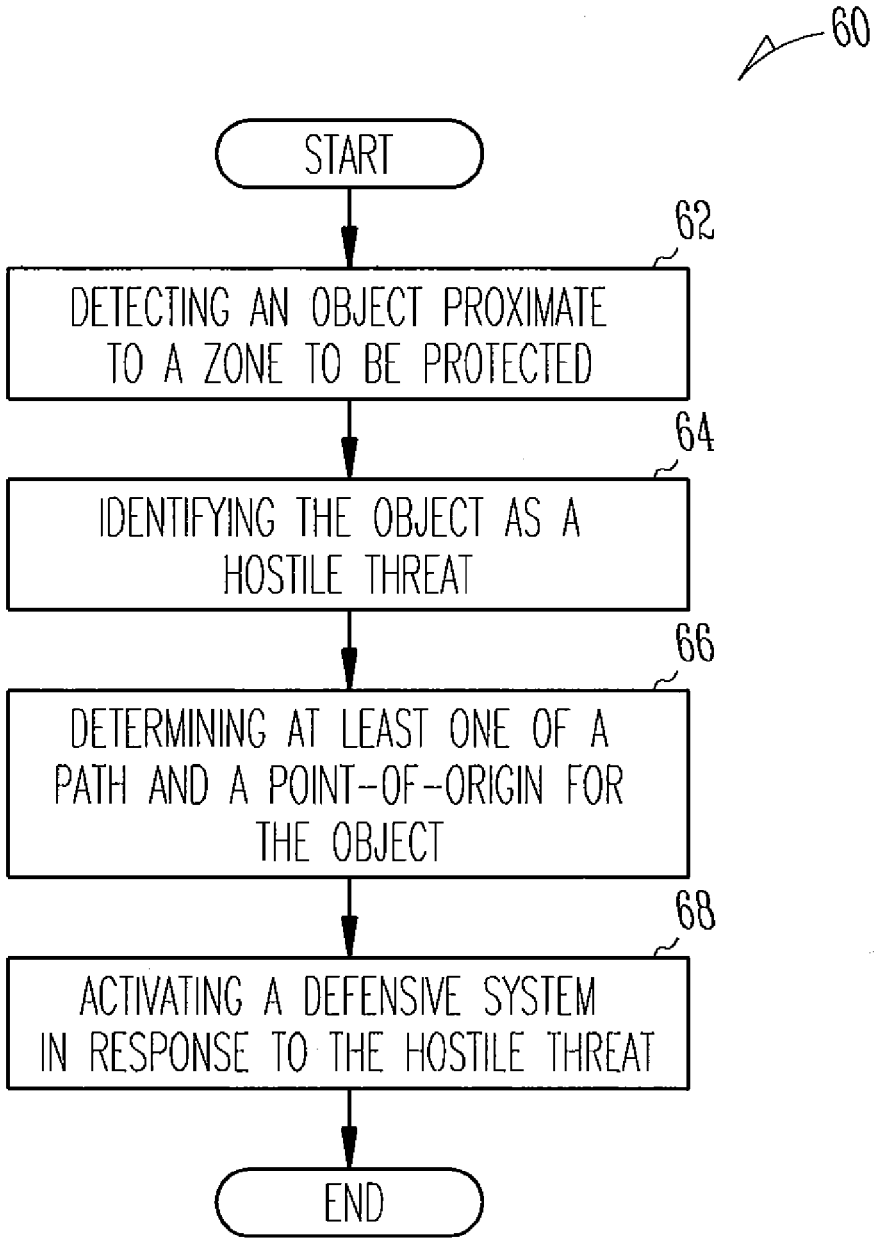
FIG. 4 is a flowchart that describes a method of protecting a physical zone from airborne and ground-based hostile threats, according to the various embodiments.

FIG. 4 is a flowchart that will be used to describe a method 60 of protecting a physical zone from airborne and ground-based hostile threats, according to the various embodiments. At 62, an object that is proximate to a physical zone that is to be protected is detected. The detection of the object may employ at least one of radar detection of the object, optical detection of the object using one or more optical sensors, infrared detection using one or more infrared sensors, and motion detection using a vibration or infrared motion detection device. The object may include an airborne object, such as an aircraft, a MANPADS, or a ground-based object, such as personnel or a terrestrial vehicle. At 64, the object is identified as a hostile threat to the zone to be protected. For example, the identification may be based upon the absence of a radar transponder signal, or optical or infrared identification. At 66, at least one of a flight or a ground path of the object may be determined, and a point-of origin of the object may be determined. Additionally, a projected point-of-impact of the object and an authorized vehicle or location within the zone may also be determined. At 68, a defensive system may be actuated in response to the hostile threat. The defensive system may include, for example, a directed energy weapon that directs focused energy towards the hostile threat. Alternatively, the defensive system may include a propelled projectile weapon system.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An Integrated Airport Domain Awareness and Response System (IADARS), comprising:

a ground detection component having at least one of an optical detection capability, a motion detection capability and a radar detection capability positioned proximate to the airport domain and configured to detect a ground-based threat to the airport domain;

an airspace detection component operable to determine a range and a track of a flight vehicle proximate to the airport domain and configured to detect an airborne threat to the airport domain;

an integration component configured to receive information from the ground detection component and the airspace detection component that is operable to assess the threat and determine a response;

a ground threat defense component configured to disable the ground-based threat based upon the determined response; and an airspace threat defense component configured to disable the airborne threat based upon the determined response.

2. The system of claim 1, wherein:

the optical detection capability comprises at least one of a video motion detection (VMD) camera, and a pan-tilt-zoom (PTZ) camera;

the motion detection capability comprises at least one of a thermal motion detection device and a vibration detection device; and the airspace detection component comprises an Air Traffic Control (ATC) system that provides radar-based surveillance proximate to the airport domain.

3. The system of claim 1, wherein the ground detection component is configured to detect the ground-based threat in an intrusion of a physical perimeter.

4. The system of claim 2, wherein the vibration detection device is incorporated into an instrumented security fence that at least partially surrounds the airport domain.

5. The system of claim 1, further comprising a communications and control apparatus configured to receive information from an array of sensors in the airspace threat defense component and to provide direction and instructions based on the information to disable the airborne threat.

6. The system of claim 2, wherein the ATC system comprises at least one of a control tower (CT) facility, a Terminal Radar Approach Control (TRACON) facility, a Flight Service Station (FSS) and an Air Route Traffic Control Center (ARTCC).

7. The system of claim 1, wherein the integration component comprises a processing unit operable to determine at least one of a path, a point of origin, and a projected point of impact for the ground-based threat and the airborne threat by triangulation.

8. The system of claim 7, wherein the integration component comprises a threat assessment unit operable to employ at least one of the path, the point of origin, the projected point of impact, a speed of the ground-based threat and the airborne threat in determining a threat.

9. The system of claim 1, wherein the ground threat defense component comprises a non-lethal directed energy weapon, and the airspace threat defense component comprises a directed energy weapon configured to disable the airborne threat.

10. An apparatus for defending a physical zone from airborne and ground-based threats, comprising:

a detection component configured to detect and track a ground-based threat and an airborne threat proximate to the physical zone;

an integration component configured to receive data from the detection component and process the data to determine a threat assessment; and a defensive component configured to receive the determined threat assessment and to disable the ground-based threat and the airborne threat proximate to the physical zone based upon the determined threat assessment.

11. The apparatus of claim 10, wherein the detection component comprises at least one of an air surveillance radar system, an optical detection system, an infrared detection system and a vibration detection system.

12. The apparatus of claim 10, wherein the defensive component comprises at least one of a non-lethal directed energy weapon operable to disable the ground-based threat, and a directed energy weapon configured to disable the airborne threat.

13. The apparatus of claim 10, wherein the integration component comprises a processing unit operably coupled to a data interface configured to receive data from the detection component, wherein the processing unit is configured to compute at least one of a path, a point of origin, and a projected point of impact for the ground-based threat and the airborne threat in determining the threat assessment.

14. The apparatus of claim 13, wherein the processing unit is coupled to a communications interface configured receive the determined threat assessment, and to communicate an alert to a law enforcement agency based upon the determined threat assessment.

15. The apparatus of claim 13, wherein:

the processing unit is coupled to a display device operable to present visual information representative of the determined threat assessment to a system operator; and the processing unit is coupled to a data storage device operable to store data received from the data interface and information received from the processing unit.

16. The apparatus of claim 10, wherein the physical zone comprises an airport or a military base or a nuclear facility or a sporting event.

17. A method of protecting a physical zone from airborne and ground-based hostile threats, comprising:

detecting and tracking a ground-based object proximate to the physical zone to be protected;

detecting and tracking an airborne object proximate to the physical zone to be protected;

identifying the ground-based object as a hostile threat directed to the physical zone based on data from detecting and tracking the ground-based object;

determining at least one of a path and a point-of-origin for the ground-based object;

identifying the airborne object as the hostile threat directed to the physical zone based on data from detecting and tracking the airborne object;

determining at least one of a path and a point-of-origin for the airborne object; and actuating a defensive system in response to the hostile threat to disable the hostile threat.

18. The method of claim 17, wherein:

detecting and tracking the ground-based object comprises detecting the ground-based object using at least one of radar, an optical sensor, an infrared sensor and a motion detection device; and detecting and tracking the airborne object comprises detecting the airborne object using at least one of radar, an optical sensor, an infrared sensor and a motion detection device.

19. The method of claim 17, further comprising:

determining a projected point-of-impact for the ground-based object;

wherein determining at least one of a path and a point-of-origin for the ground-based object comprises determining the path, the point-of-origin and the point-of-impact for the ground-based object by triangulation;

determining a projected point-of-impact for the airborne object; and wherein determining at least one of a path and a point-of-origin for the airborne object comprises determining the path, the point-of-origin and the point-of-impact for the airborne object by triangulation.

20. The method of claim 17, wherein actuating a defensive system comprises directing focused energy from a directed energy weapon towards the airborne object or the ground-based object.

* * * * *